US011438687B2

(12) United States Patent
Fukui

(10) Patent No.: US 11,438,687 B2
(45) Date of Patent: Sep. 6, 2022

(54) SPEAKER DEVICE AND ASSIGNMENT METHOD

(71) Applicant: SONY CORPORATION, Tokyo (JP)

(72) Inventor: Kimihiro Fukui, Saitama (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/040,535

(22) PCT Filed: Feb. 14, 2019

(86) PCT No.: PCT/JP2019/005237
§ 371 (c)(1),
(2) Date: Sep. 22, 2020

(87) PCT Pub. No.: WO2019/187736
PCT Pub. Date: Oct. 3, 2019

(65) Prior Publication Data

US 2021/0029440 A1 Jan. 28, 2021

(30) Foreign Application Priority Data

Mar. 30, 2018 (JP) ..... JP2018-066737

(51) Int. Cl.
*H04R 1/10* (2006.01)

(52) U.S. Cl.
CPC ..... *H04R 1/1041* (2013.01); *H04R 1/1025* (2013.01)

(58) Field of Classification Search
CPC ..... H04R 1/1041
See application file for complete search history.

(56) References Cited

U.S. PATENT DOCUMENTS

2016/0357510 A1 12/2016 Watson et al.
2016/0360350 A1* 12/2016 Watson ..... H04R 1/1091
2017/0064433 A1 3/2017 Hirsch et al.
2017/0093079 A1 3/2017 Wagman et al.
2017/0195771 A1* 7/2017 Hung ..... H04R 1/10
2017/0244821 A1* 8/2017 Ishida ..... H04M 1/72409
2018/0091637 A1 3/2018 Ishida et al.
2018/0091884 A1 3/2018 Minoo et al.
2018/0091887 A1 3/2018 Minoo et al.
2018/0091965 A1* 3/2018 Watson ..... H04W 52/0209
(Continued)

FOREIGN PATENT DOCUMENTS

CN 106551494 A 4/2017
CN 106851452 A 6/2017
(Continued)

OTHER PUBLICATIONS

"Deleting Registered Information (Reset)", GLIDiC Sound Air TW-7000, URL: https://glidic.jp/tw-7000/manual/manual_SB-WS72-MRTW.pdf, Dec. 2018, 02 pages.
(Continued)

*Primary Examiner* — Simon King
(74) *Attorney, Agent, or Firm* — Chip Law Group

(57) ABSTRACT

There is provided a speaker device including a controller that controls assignment of a process to a key on the basis of whether or not the speaker device is stored in a case. The key is configured to be inputted to an operation section of the speaker device. The process is executed in a case where the key is inputted to the operation section.

9 Claims, 6 Drawing Sheets

(56) References Cited

U.S. PATENT DOCUMENTS

| | | | | |
|---|---|---|---|---|
| 2018/0109867 | A1 | 4/2018 | Hirsch et al. | |
| 2018/0131793 | A1* | 5/2018 | Kim | H04R 1/1016 |
| 2018/0367883 | A1 | 12/2018 | Minoo et al. | |
| 2019/0028795 | A1 | 1/2019 | Hirsch et al. | |
| 2019/0089823 | A1 | 3/2019 | Ishida et al. | |
| 2020/0336820 | A1* | 10/2020 | Tasaka | H04N 5/76 |

FOREIGN PATENT DOCUMENTS

| | | | |
|---|---|---|---|
| CN | 107094201 | A | 8/2017 |
| CN | 107683459 | A | 2/2018 |
| CN | 108353357 | A | 7/2018 |
| EP | 3151582 | A1 | 4/2017 |
| EP | 3188502 | A1 | 7/2017 |
| EP | 3209003 | A1 | 8/2017 |
| EP | 3304951 | A1 | 4/2018 |
| EP | 3342214 | A1 | 7/2018 |
| EP | 3481037 | A1 | 5/2019 |
| JP | 2000-333286 | A | 11/2000 |
| JP | 2017-098943 | A | 6/2017 |
| JP | 2017-121060 | A | 7/2017 |
| JP | 2017-147652 | A | 8/2017 |
| KR | 10-2017-0039568 | A | 4/2017 |
| KR | 10-2017-0138588 | A | 12/2017 |
| TW | 201733366 | A | 9/2017 |
| WO | 2016/196838 | A1 | 12/2016 |
| WO | 2017/036986 | A1 | 3/2017 |

OTHER PUBLICATIONS

International Search Report and Written Opinion of PCT Application No. PCT/JP2019/005237, dated May 14, 2019, 08 pages of ISRWO.

Extended European Search Report of EP Application No. 19777877.2, dated Mar. 22, 2021, 08 pages.

* cited by examiner

[FIG. 1]
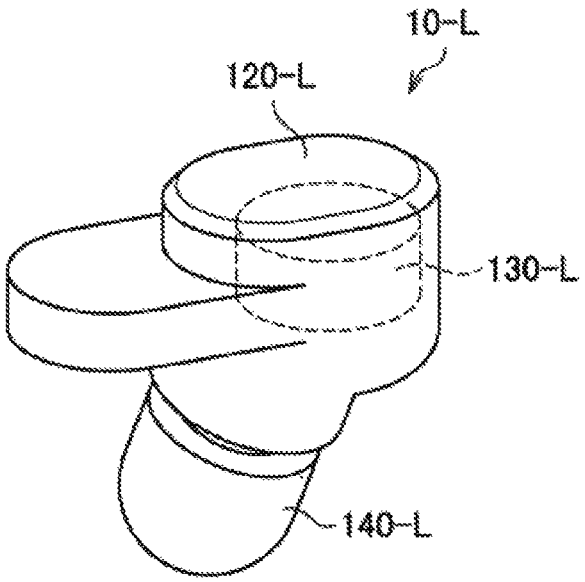
[FIG. 2]
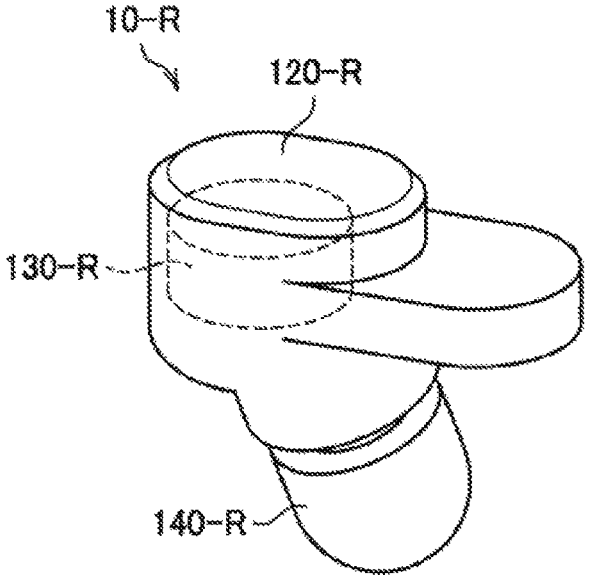

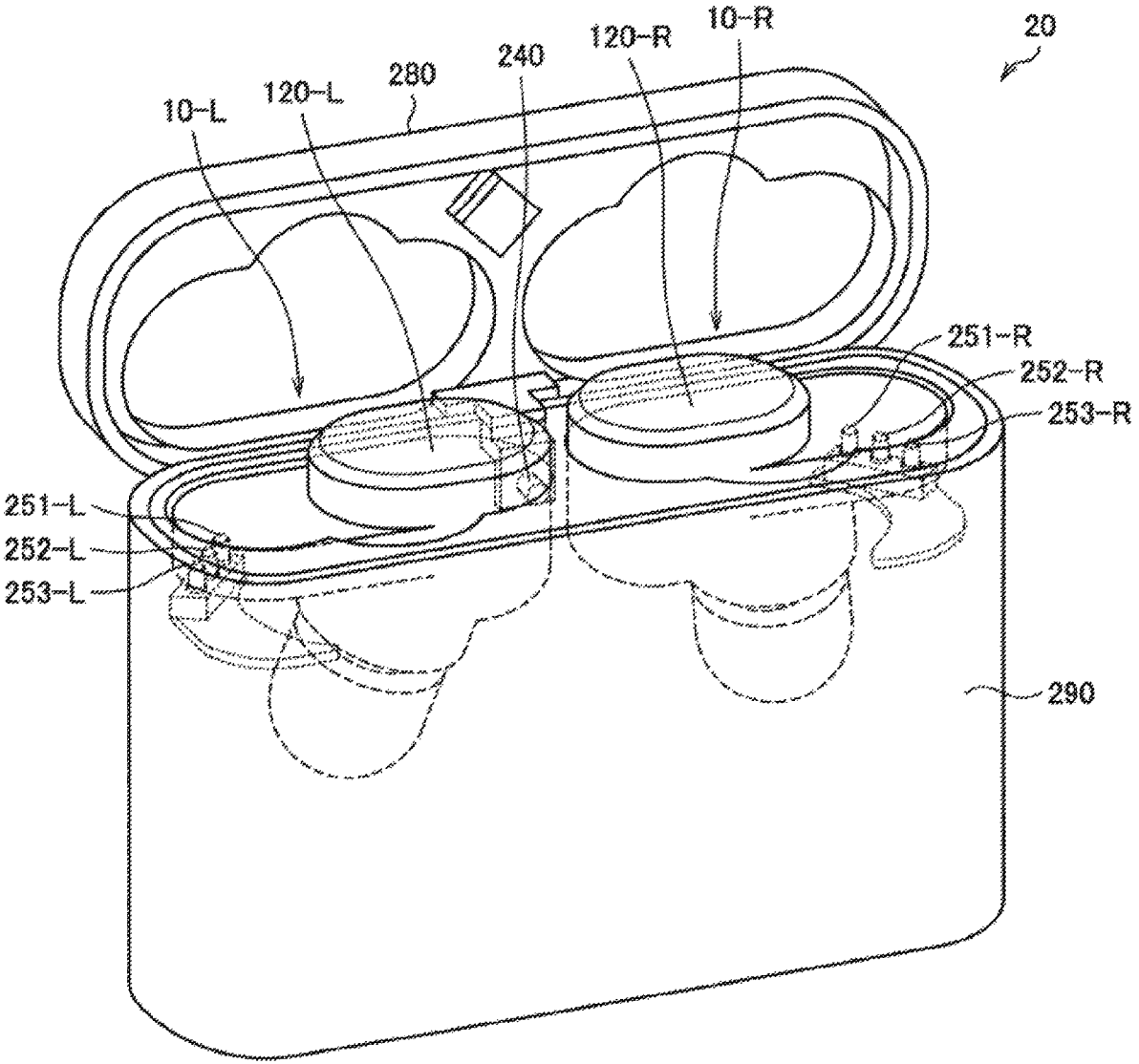
[FIG. 3]

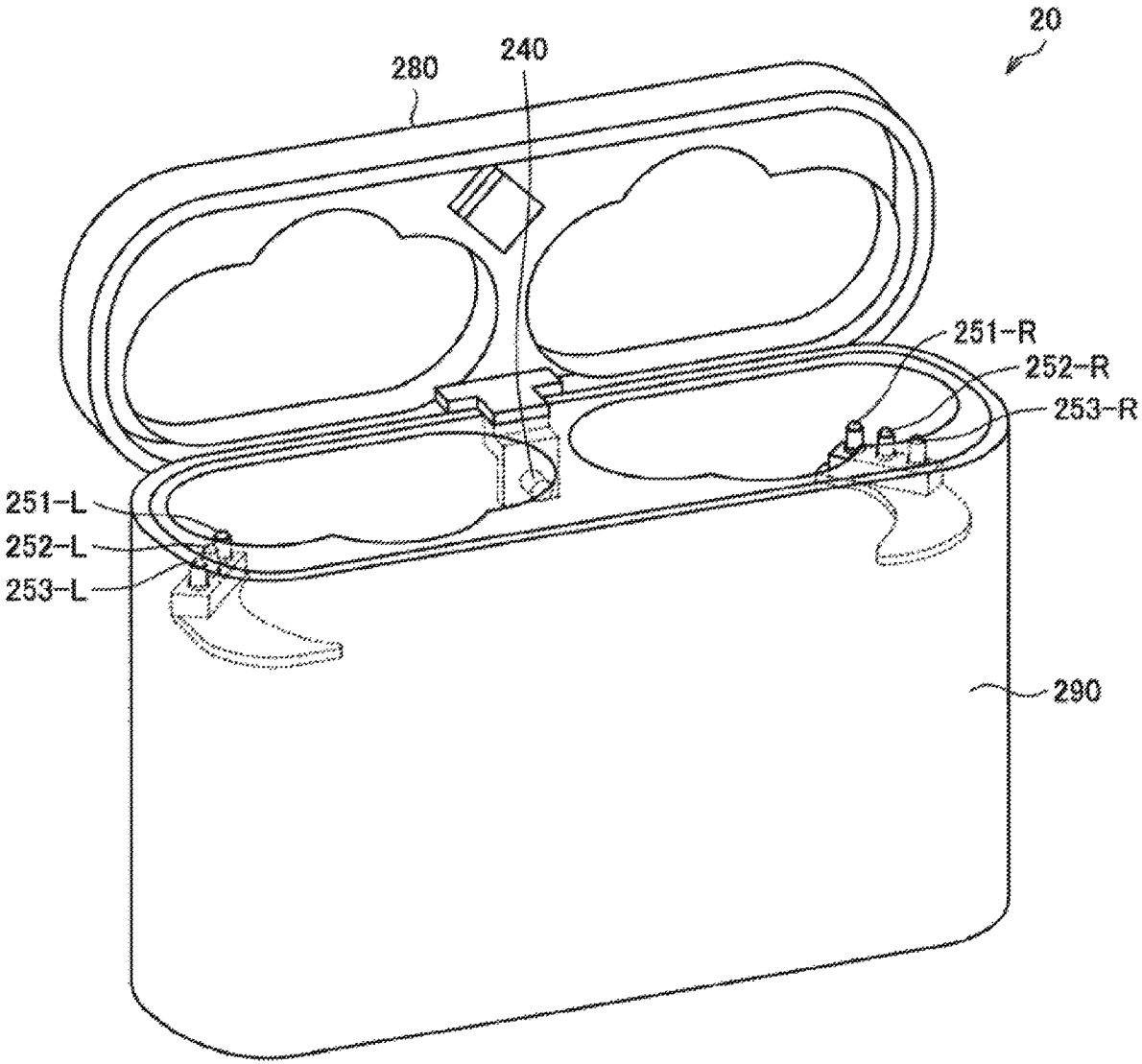
[FIG. 4]

[FIG. 5]
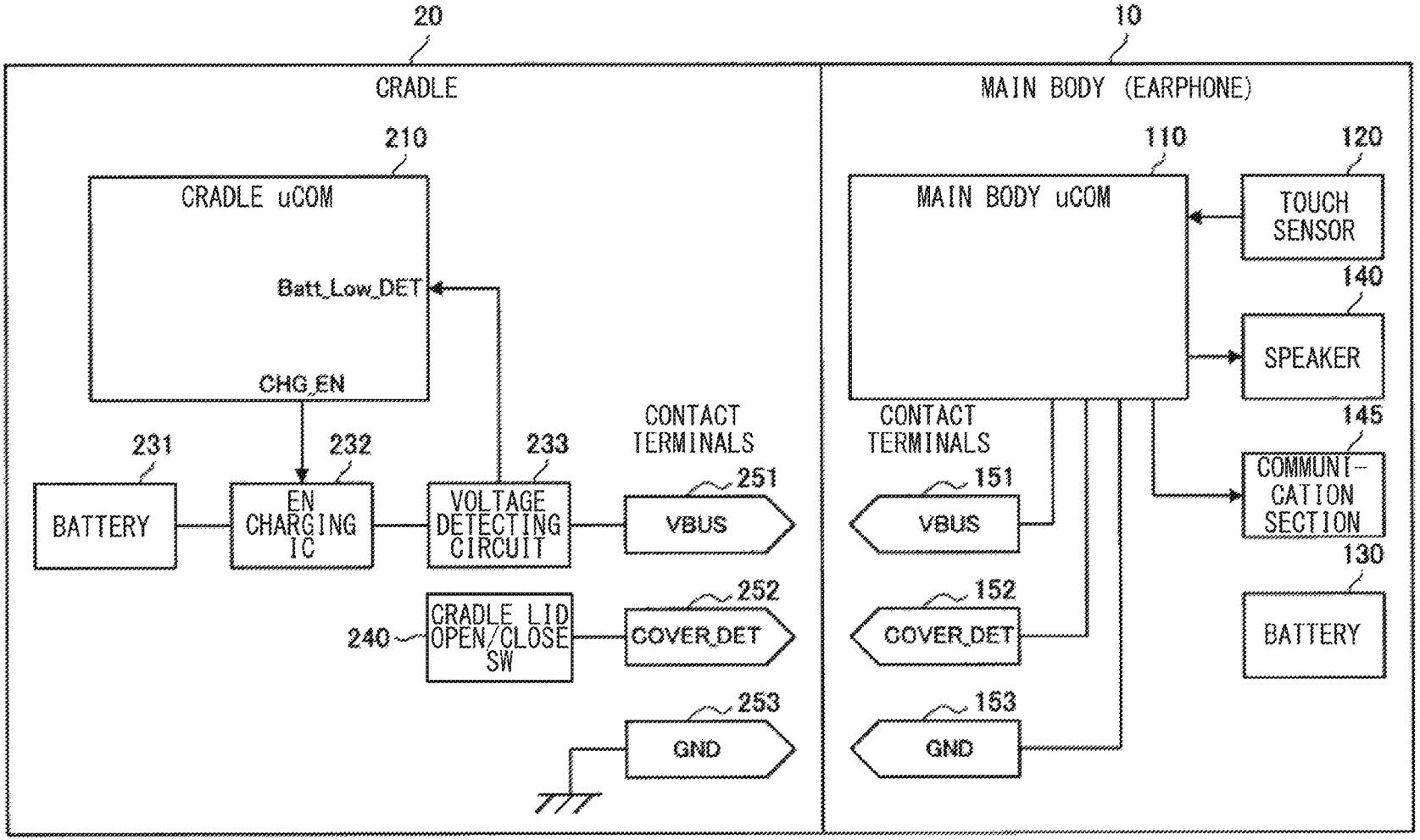

[FIG. 6]

| LOCATION OF MAIN BODY (INSIDE OR OUTSIDE CRADLE) | STATE OF CRADLE LID | ELECTRIC POWER REMAINING IN BATTERY OF CRADLE | KEY ASSIGNMENT |
|---|---|---|---|
| OUTSIDE | — | — | FIRST ASSIGNMENT |
| INSIDE | CLOSED | PRESENT | DISABLED |
| INSIDE | OPEN | PRESENT | SECOND ASSIGNMENT |
| INSIDE | CLOSED | ABSENT | DISABLED |
| INSIDE | OPEN | ABSENT | FIRST ASSIGNMENT |

[FIG. 7]
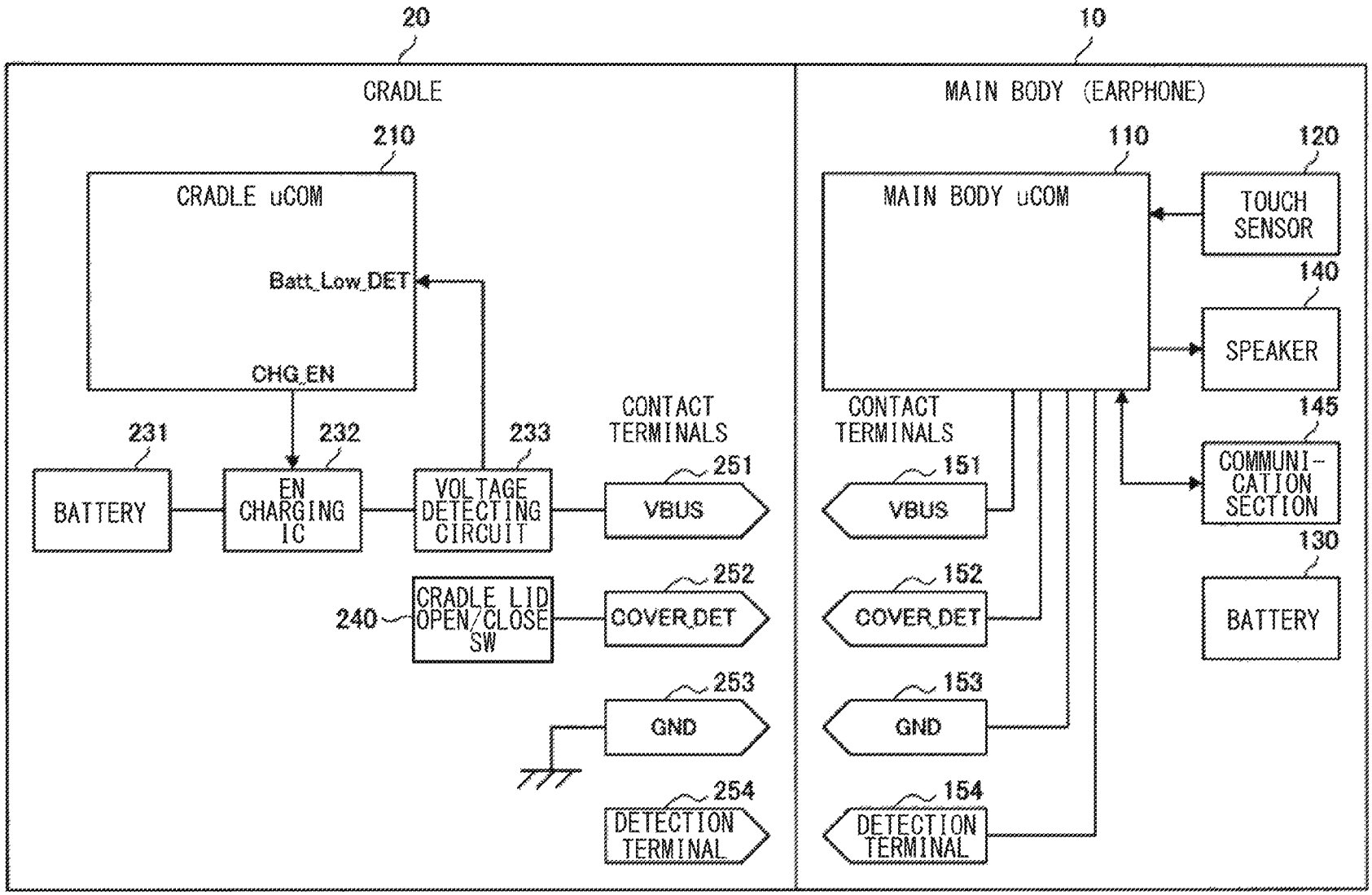

SPEAKER DEVICE AND ASSIGNMENT METHOD

CROSS REFERENCE TO RELATED APPLICATIONS

This application is a U.S. National Phase of International Patent Application No. PCT/JP2019/005237 filed on Feb. 14, 2019, which claims priority benefit of Japanese Patent Application No. JP 2018-066737 filed in the Japan Patent Office on Mar. 30, 2018. Each of the above-referenced applications is hereby incorporated herein by reference in its entirety.

TECHNICAL FIELD

The present disclosure relates to a speaker device and an assignment method.

BACKGROUND ART

In recent years, opportunities for listening to sound outputted from a speaker device such as an earphone or a headphone worn on a body have increased. Various types of sound such as music or news reporting are assumed as the sound to be outputted from the speaker device. Furthermore, various functions are assumed as functions of the speaker device.

For example, an earphone is disclosed that has a touch sensor and allows music being played to be changed through a user's touch operation on the touch sensor (see, for example, PTL 1). According to such a technique, a process of changing music being played is assigned to the touch operation as a process to be executed by the speaker device in a case where the touch operation is inputted to the touch sensor. Furthermore, in a case where the earphone is stored in a charging case, the battery of the earphone may be charged by receiving electric power from the charging case.

CITATION LIST

Patent Literature

PTL 1: Japanese Unexamined Patent Application Publication No. 2000-333286

SUMMARY OF THE INVENTION

Problems to be Solved by the Invention

As described above, a process is assigned to a key. The key is configured to be inputted. The process is executed in a case where the key is inputted. In some cases, however, the number of types of keys configured to be inputted is restricted. In such a case, it is likely that some processes are not assigned to any key. It is therefore desirable to provide technology that enables a process to be more effectively assigned to a key.

Means for Solving the Problems

According to the present disclosure, there is provided a speaker device including a controller that controls assignment of a process to a key on the basis of whether or not the speaker device is stored in a case. The key is configured to be inputted to an operation section of the speaker device. The process is executed in a case where the key is inputted to the operation section.

According to the present disclosure, there is provided an assignment method including controlling assignment of a process to a key on the basis of whether or not a speaker device is stored in a case. The key is configured to be inputted to an operation section of the speaker device. The process is executed in a case where the key is inputted to the operation section.

Effects of the Invention

As described above, according to the present disclosure, the technology is provided that enables a process to be more effectively assigned to a key. It is to be noted that the above-described effects are not necessarily limitative. Any of the effects indicated in this description or other effects that may be understood from this description may be exerted in addition to the above-described effects or in place of the above-described effects.

BRIEF DESCRIPTION OF DRAWING

FIG. 1 is a diagram illustrating an example of external appearance of an earphone (to be put in a left ear) according to an embodiment of the present disclosure.

FIG. 2 is a diagram illustrating an example of external appearance of an earphone (to be put in a right ear) according to the embodiment of the present disclosure.

FIG. 3 is a diagram illustrating an example of external appearance of a cradle in which the earphones are stored.

FIG. 4 is a diagram illustrating an example of the external appearance of the cradle in which the earphones are not stored.

FIG. 5 is a diagram illustrating a functional configuration of each earphone (main body) and a functional configuration of the cradle.

FIG. 6 is a diagram illustrating an example of correspondence relationship between various states and assignment of processes to keys.

FIG. 7 is a diagram for describing a modification example.

MODES FOR CARRYING OUT THE INVENTION

The following describes a preferred embodiment of the present disclosure in detail with reference to the accompanying drawings. It is to be noted that, in this specification and the accompanying drawings, components that have substantially the same functional configuration are indicated by the same reference signs and redundant description thereof is thus omitted.

In addition, in this description and the drawings, a plurality of components that has substantially the same or similar functional configuration is sometimes distinguished from each other by attaching different numerals after the same reference signs. However, in a case where there is no need in particular to distinguish a plurality of components that has substantially the same or similar functional configuration, the same reference signs alone are attached. In addition, similar components of different embodiments are sometimes distinguished by attaching different alphabets to the same reference signs. However, in a case where there is no need in particular to distinguish similar components from each other, the same reference signs alone are attached.

It is to be noted that description is given in the following order.

1. Overview
2. Details of Embodiment
2.1. Example of System Configuration
2.2. Example of Assignment
3. Conclusion
4. Modification Example

1. OVERVIEW

First, an overview of an embodiment of the present disclosure is described. In recent years, opportunities for listening to sound outputted from a speaker device such as an earphone or a headphone worn on a body have increased. Various types of sound such as music or news reporting are assumed as the sound to be outputted from the speaker device. Furthermore, various functions are assumed as functions of the speaker device.

For example, an earphone is disclosed that has a touch sensor and allows music being played to be changed through a user's touch operation on the touch sensor. According to such a technique, a process of changing music being played is assigned to the touch operation as a process to be executed by the speaker device in a case where the touch operation is inputted to the touch sensor. Furthermore, in a case where the earphone is stored in a charging case, the battery of the earphone may be charged by receiving electric power from the charging case.

As described above, a process is assigned to a key. The key is configured to be inputted. The process is executed in a case where the key is inputted. In some cases, however, the number of types of keys configured to be inputted is restricted. In such a case, it is likely that some processes are not assigned to any key. Herein, therefore, the technology is mainly described that enables a process to be more effectively assigned to a key.

It is to be noted that description is given using mainly an earphone as an example of a speaker device in the embodiment of the present disclosure. However, the earphone is merely an example of the speaker device. As such, a speaker device other than the earphone may be used instead of the earphone. For example, a headphone may be used instead of the earphone. In addition, description is given using mainly a cradle as an example of a charging case in the embodiment of the present disclosure. However, the cradle is merely an example of the charging case. As such, a case other than the cradle may be used instead of the cradle.

The overview of the embodiment of the present disclosure has been described above.

2. DETAILS OF EMBODIMENT

The following describes the details of the embodiment of the present disclosure.

[2.1. Example of System Configuration]

First, examples of configurations of the earphone and the cradle according to the embodiment of the present disclosure are described. It is to be noted that the following description involves an earphone to be put in a left ear and an earphone to be put in a right ear. The earphone to be put in a left ear and the earphone to be put in a right ear may be each referred to as an "earphone". It may be determined or not particularly determined which of the two earphones is the earphone to be put in a left ear and which is the earphone to be put in a right ear. Alternatively, the earphone may be configured to be put in both left and right ears.

FIG. 1 is a diagram illustrating an example of the external appearance of an earphone (to be put in a left ear) according to the embodiment of the present disclosure. As illustrated in FIG. 1, an earphone 10-L (to be put in a left ear) is to be put in the left ear of a user, and includes a touch sensor 120-L, a speaker 140-L, and a battery 130-L. FIG. 2 is a diagram illustrating an example of the external appearance of an earphone (to be put in a right ear) according to the embodiment of the present disclosure. As illustrated in FIG. 2, an earphone 10-R (to be put in a right ear) is to be put in the right ear of the user, and includes a touch sensor 120-R, a speaker 140-R, and a battery 130-R.

FIG. 3 is a diagram illustrating an example of the external appearance of a cradle 20 in which the earphones are stored. Referring to FIG. 3, the cradle 20 includes a lid section 280 and a storage section 290. FIG. 3 illustrates a state in which the lid section 280 is open relative to the storage section 290.

The storage section 290 has a storage space for the earphone 10-L (to be put in a left ear). An electric power supply terminal 251-L (VBAS), a lid open/close detecting terminal 252-L (COVER_DET), and a ground terminal (GND) 253-L are provided in this storage space. Referring to FIG. 3, the earphone 10-L (to be put in a left ear) is stored in the storage space. At this time, the electric power supply terminal 251-L (VBAS), the lid open/close detecting terminal 252-L (COVER_DET), and the ground terminal (GND) 253-L are coupled to the respective corresponding coupling terminals of the earphone 10-L (to be put in a left ear).

Furthermore, a cradle lid open/close switch 240 is provided in the storage section 290. This cradle lid open/close switch 240 detects whether the lid section 280 is in an open state or a closed state. The open or closed state of the lid section 280 detected by the cradle lid open/close switch 240 is outputted to the corresponding coupling terminal of the earphone 10-L (to be put in a left ear) through the lid open/close detecting terminal 252-L. In the embodiment of the present disclosure, as an example, the closed state of the lid section 280 is outputted to the corresponding coupling terminal of the earphone 10-L (to be put in a left ear) through the "presence" of voltage output from the lid open/close detecting terminal 252-L, and the open state of the lid section 280 is outputted to the corresponding coupling terminal of the earphone 10-L (to be put in a left ear) through the "absence" of voltage output from the lid open/close detecting terminal 252-L.

FIG. 4 is a diagram illustrating an example of the external appearance of the cradle 20 in which the earphones are not stored. As in FIG. 3, FIG. 4 illustrates a state in which the lid section 280 is open relative to the storage section 290. However, the earphone 10-L (to be put in a left ear) or the earphone 10-R (to be put in a right ear) is not stored in the cradle 20.

As illustrated in FIGS. 3 and 4, the lid section 280 is swingable in a first direction (a closing direction) about a coupling section between the lid section 280 and the storage section 290 manually by the user (or automatically) with the earphone 10-L (to be put in a left ear) and the earphone 10-R (to be put in a right ear) stored or not stored in the cradle 20. This allows the lid section 280 to be closed relative to the storage section 290.

In addition, the lid section 280 is swingable in a second direction (an opening direction) opposed to the first direction (the closing direction) about the coupling section between the lid section 280 and the storage section 290 manually by the user (or automatically) with the earphone 10-L (to be put in a left ear) and the earphone 10-R (to be put in a right ear)

stored or not stored in the cradle 20. This allows the lid section 280 to be open relative to the storage section 290.

FIG. 5 is a diagram illustrating the functional configuration of the earphone 10 (main body) and the functional configuration of the cradle 20. As illustrated in FIG. 5, the earphone 10 includes a main body uCOM (a main body microcomputer) 110, a touch sensor 120, a battery 130, a speaker 140, a communication section 145, an electric power acquiring terminal 151 (VBAS), a lid open/close detecting terminal 152 (COVER_DET), and a ground terminal (GND) 153.

The touch sensor 120 receives operations from the user. For example, the touch sensor 120 receives, from the user, a single tap operation (an operation of tapping once), a double tap operation (an operation of tapping twice consecutively within a predetermined period of time), a triple tap operation (an operation of tapping three times consecutively within a predetermined period of time), a long press operation, and a simultaneous long press operation with the other earphone. The touch sensor 120 is merely an example of an operation section. That is, the earphone 10 may have an operation section (a button, for example) other than the touch sensor that is able to receive operations inputted by the user in place of the touch sensor 120 or in addition to the touch sensor 120. It is to be noted that no particular limitations are placed on the position of the touch sensor 120.

In a case where the earphone 10 receives sound data played by a playback device paired with the earphone 10, the speaker 140 outputs sound on the basis of the sound data. For example, the speaker 140 is inserted into the earhole of the user's left ear and outputs sound. This causes the sound outputted from the speaker 140 to be perceived by the user's left ear. It is to be noted that the embodiment of the present disclosure is mainly on the assumption that the earphone 10 receives the sound data from the playback device through wireless communication. However, the earphone 10 may receive the sound data from the playback device through wired communication.

The battery 130 supplies electric power to be used for various operations of the earphone 10. The embodiment of the present disclosure is on the assumption that the battery 130 includes a rechargeable cell. When the cradle 20 (FIG. 3) supplies electric power to the earphone 10, the battery 130 accumulates the electric power supplied from the cradle 20 (FIG. 3). However, the battery 130 does not necessarily have to include a rechargeable cell. It is to be noted that no particular limitations are placed on the position of the battery 130.

The communication section 145 performs communication with the paired playback device. For example, the communication section 145 receives sound data from the paired playback device as described above.

The main body uCOM 110 includes CPU (Central Processing Unit) and a memory. Functions of the main body uCOM 110 are achieved through the CPU executing a program stored in the memory. It is to be noted that the main body uCOM 110 may function as a controller that controls operations of the earphone 10.

The electric power acquiring terminal 151 (VBAS) is coupled to an electric power supply terminal 251 (VBAS) of the cradle 20. The lid open/close detecting terminal 152 (COVER_DET) is coupled to a lid open/close detecting terminal 252 of the cradle 20. The ground terminal (GND) 153 is coupled to a ground terminal (GND) 253 of the cradle 20.

The cradle 20 includes a cradle uCOM (a cradle microcomputer) 210, a battery 231, EN charging IC (Integrated Circuit) 232, a voltage detecting circuit 233, the cradle lid open/close switch 240, the electric power supply terminal 251 (VBAS), the lid open/close detecting terminal 252 (COVER_DET), and the ground terminal (GND) 253.

The battery 231 accumulates electric power to be supplied to the earphone 10. The voltage detecting circuit 233 detects whether or not the amount of electric power remaining in the battery 231 is lower than a threshold. In a case where the amount of electric power remaining in the battery 231 is lower than the threshold, the voltage detecting circuit 233 outputs the fact to the cradle uCOM 210. Upon receiving the input indicating that the amount of electric power remaining in the battery 231 is lower than the threshold, the cradle uCOM 210 controls the battery 231 to cause the EN charging IC 232 to stop voltage output to the electric power supply terminal 251 (VBAS).

In the embodiment of the present disclosure, the main body uCOM 110 controls the assignment of a process to a key on the basis of whether or not the user has an intention of using the earphone 10. The key is configured to be inputted to the touch sensor 120. The process is executed in a case where the key is inputted to the touch sensor 120. This enables a process to be more effectively assigned to a key than in a case where a process is unconditionally assigned to a key regardless of whether or not the user has an intention of using the earphone 10.

More specifically, it is possible to consider that the user does not have an intention of using the earphone 10 in a case where the earphone 10 is stored in the cradle 20, and it is possible to consider that the user has an intention of using the earphone 10 in a case where the earphone 10 is not stored in the cradle 20. In the embodiment of the present disclosure, the main body uCOM 110 then controls the assignment of a process to a key on the basis of whether or not the earphone 10 is stored in the cradle 20. The key is configured to be inputted to the touch sensor 120. The process is executed in a case where the key is inputted to the touch sensor 120.

For example, the main body uCOM 110 assigns a first process to a first key (first assignment) in a case where the earphone 10 is not stored in the cradle 20. In contrast, the main body uCOM 110 assigns a second process to a second key (second assignment) in a case where the earphone 10 is stored in the cradle 20. Here, no limitations are placed on each of the first and second processes. For example, the second process may include at least any one of an initialization process or a hardware reset process because the second process is a process to be executed in a case where the earphone 10 is stored in the cradle 20.

The description here is on the assumption that the main body uCOM 110 assigns a process "play/stop" to a key "single tap" of the earphone 10-R (to be put in a right ear), a process "playback location advancing" to a key "double tap" of the earphone 10-R (to be put in a right ear), a process "playback location reversing" to a key "triple tap" of the earphone 10-R (to be put in a right ear), and a process "speech recognition" to a key "long press" of the earphone 10-R (to be put in a right ear) in a case where the earphone 10 is not stored in the cradle 20.

The description here is also on the assumption that the main body uCOM 110 assigns a process "noise-canceling and external sound capture function (ambient function)" to a key "double tap" of the earphone 10-L (to be put in a left ear), and a process "quick attention function" to a key "long press" of the earphone 10-L (to be put in a left ear) in a case where the earphone 10 is not stored in the cradle 20. The quick attention function may mean a function of turning down the volume of sound data being played to make ambient sound (for example, guidance messages outputted to the inside of a train) easier to hear only while the touch sensor is pressed for a long time.

The description here is also on the assumption that the main body uCOMs 110 assign a process "paring with a playback device" to a key "simultaneous long press for X seconds" of the earphone 10-R (to be put in a right ear) and the earphone 10-L (to be put in a left ear) in a case where the earphones 10 are not stored in the cradle 20. For example, X may be about seven seconds or the like, but no particular limitations are placed on the length of X. The assignment that is performed in a case where the earphones 10 are not stored in the cradle 20 is also referred to as "first assignment" below.

In contrast, the description here is on the assumption that the main body uCOMs 110 assign a process "initialization process" to a key "simultaneous long press for Y seconds" of the earphone 10-R (to be put in a right ear) and the earphone 10-L (to be put in a left ear) in a case where the earphones 10 are stored in the cradle 20. For example, Y may be about ten seconds or the like, but no particular limitations are placed on the length of Y.

In contrast, the description here is on the assumption that the main body uCOMs 110 assign a process "hardware reset process" to a key "simultaneous or one-by-one long press for Z seconds" of the earphone 10-R (to be put in a right ear) and the earphone 10-L (to be put in a left ear) in a case where the earphones 10 are stored in the cradle 20. For example, Z may be about twenty seconds or the like, but no particular limitations are placed on the length of Z. The assignment that is performed in a case where the earphones 10 are stored in the cradle 20 is also referred to as "second assignment" below.

It is to be noted that the initialization process may mean a process of returning the earphone 10 to a state at the time of shipment of the earphone 10 from a factory by clearing setting information of the earphone 10. This may delete paring information, audio quality setting information, or the like of the earphone. For example, the initialization process may be executed in a case of a failure in normal communication due to dust accumulated in the earphone 10 or in a case of a failure in normal paring of the earphone 10 with a playback device due to an error occurring during the paring.

In contrast, the hardware reset process may be a process of rebooting the main body uCOM 110. For example, the hardware reset process may be executed in a case of a malfunction of the main body uCOM 110 due to a software operation freeze in the main body uCOM 110 or in a case of a malfunction of the main body uCOM 110 due to shock from the outside onto the earphone 10.

Any command other than a command for the hardware reset process is understood by the main body uCOM 110, and the main body uCOM 110 actively executes such a command in accordance with command specifications. In contrast, the command for the hardware reset process is executed by directly hitting a reset terminal of the main body uCOM 110 from the outside and forcibly resetting the uCOM 110. The main body uCOM 110 becomes unable to further count the number of seconds for the long press when the reset terminal is directly hit from the outside. The length of time for the long press for executing the hardware reset process then has to be longer than the length of time for the long press for executing any command other than the command for the hardware reset process.

The description here is mainly on the assumption that whether or not the earphone 10 is stored in the cradle 20 is determined on the basis of whether or not the main body uCOM 110 receives electric power from the cradle 20 via the electric power supply terminal 251 (VBAS) and the electric power acquiring terminal 151 (VBAS). This enables the main body uCOM 110 to execute a process (for example, the initialization process or the hardware reset process) to be executed in a case where the earphone 10 is stored in the cradle 20, by using the electric power received from the cradle 20 via the electric power supply terminal 251 (VBAS) and the electric power acquiring terminal 151 (VBAS) even in a case where the amount of electric power remaining in the battery 130 of the earphone 10 is low.

It is to be noted that even in a case where the earphone 10 is stored in the cradle 20, the main body uCOM 110 is unable to receive electric power from the cradle 20 via the electric power supply terminal 251 (VBAS) and the electric power acquiring terminal 151 (VBAS) in a case where the amount of electric power remaining in the battery 231 of the cradle 20 is lower than a threshold. In such a case, the main body uCOM 110 is unable to execute a process (for example, the initialization process or the hardware reset process) to be executed in a case where the earphone 10 is stored in the cradle 20.

Therefore, in such a case, the main body uCOM 110 may execute a process (for example, the initialization process or the hardware reset process) to be executed in a case where the earphone 10 is stored in the cradle 20 after the amount of electric power remaining in the battery 231 of the cradle 20 is restored to a level higher than the threshold and the main body uCOM 110 receives electric power from the cradle 20 via the electric power supply terminal 251 (VBAS) and the electric power acquiring terminal 151 (VBAS).

Furthermore, the user may touch the touch sensor 120 at unintended timing. In such a case, an operation against the user's intention (erroneous operation) may be sometimes executed. Examples of the erroneous operation include the execution of the initialization process or the hardware reset process by pressing the touch sensor 120 for a long time. The main body uCOM 110 therefore preferably controls whether to enable or disable the input of a key to the touch sensor 120 on the basis of whether or not the lid section 280 of the cradle 20 is open in a case where the earphone 10 is stored in the cradle 20. This reduces the possibility of an erroneous operation.

For example, in a case where the earphone 10 is stored in the cradle 20 and the lid section 280 is closed, the main body uCOM 110 may disable the input of a key to the touch sensor 120 because it is unlikely that the user inputs any operation to the touch sensor 120. Furthermore, the main body uCOM 110 may start to charge the battery 130 (and power off the earphone 10) by using electric power received via the electric power supply terminal 251 (VBAS) and the electric power acquiring terminal 151 (VBAS) in a case where the earphone 10 is stored in the cradle 20 and the lid section 280 is closed.

In contrast, in a case where the earphone 10 is stored in the cradle 20 and the lid section 280 is open, the main body uCOM 110 may enable the input of a key to the touch sensor 120 because it is likely that the user inputs an operation to the touch sensor 120.

The examples of configurations of the earphone 10 and the cradle 20 according to the embodiment of the present disclosure have been described above.

[2.2. Example of Assignment]

The following describes an example of correspondence relationship between various states and the assignment of processes to keys in more detail with reference to FIG. 6. FIG. 6 is a diagram illustrating an example of correspondence relationship between various states and assignment of processes to keys. Referring to FIG. 6, "location of main body (inside or outside cradle)", "state of cradle lid", "electric power remaining in battery of cradle" are listed as examples of the states, and "key assignment" corresponding to the states is listed.

The "location of main body (inside or outside cradle)" indicates whether the earphone 10 is "inside" or "outside" the cradle 20 (whether or not the earphone 10 is stored in the cradle 20). The "state of cradle lid" indicates whether the lid section 280 of the cradle 20 is in a "closed" state or in an "open" state. The "electric power remaining in battery of cradle" indicates whether electric power remaining in the cradle 20 is "present" or "absent", which is, in other words, whether the amount of electric power remaining in the cradle 20 is higher than or lower than the threshold.

Furthermore, the "key assignment" indicates any of "first assignment" that is assignment performed in a case where the earphone 10 is not stored in the cradle 20, "second assignment" that is assignment performed in a case where the earphone 10 is stored in the cradle 20, and key input being "disabled".

The first row in FIG. 6 assumes a case where the "location of main body" is "outside" the cradle 20. That is, a case is assumed where the main body uCOM 110 does not receive electric power from the cradle 20 via the electric power supply terminal 251 (VBAS) and the electric power acquiring terminal 151 (VBAS) because the earphone 10 is located outside the cradle 20. In such a case, the main body uCOM 110 performs the "first assignment". In this case, key input is kept "enabled".

The second row in FIG. 6 assumes a case where the "location of main body" is "inside" the cradle 20, the "state of cradle lid" is "closed", and the "electric power remaining in battery of cradle" is "present". That is, a case is assumed where the main body uCOM 110 receives electric power from the cradle 20 via the electric power supply terminal 251 (VBAS) and the electric power acquiring terminal 151 (VBAS) because the earphone 10 is located inside the cradle 20, the lid section 280 is in the closed state, and the electric power remaining in the battery 231 of the cradle 20 is "present". In such a case, the main body uCOM 110 "disables" key input. In this case, the assignment of processes to keys is maintained.

The third row in FIG. 6 assumes a case where the "location of main body" is "inside" the cradle 20, the "state of cradle lid" is "open", and the "electric power remaining in battery of cradle" is "present". That is, a case is assumed where the main body uCOM 110 receives electric power from the cradle 20 via the electric power supply terminal 251 (VBAS) and the electric power acquiring terminal 151 (VBAS) because the earphone 10 is located inside the cradle 20, the lid section 280 is in the open state, and the electric power remaining in the battery 231 of the cradle 20 is "present". In such a case, the main body uCOM 110 performs the "second assignment". In this case, key input is kept "enabled".

The fourth row in FIG. 6 assumes a case where the "location of main body" is "inside" the cradle 20, the "state of cradle lid" is "closed", and the "electric power remaining in battery of cradle" is "absent". That is, a case is assumed where the main body uCOM 110 does not receive electric power from the cradle 20 via the electric power supply terminal 251 (VBAS) and the electric power acquiring terminal 151 (VBAS) due to the absence of electric power remaining in the battery 231 of the cradle 20, and the lid section 280 is in the closed state. In such a case, the main body uCOM 110 "disables" key input. In this case, the assignment of processes to keys is maintained.

The fifth row in FIG. 6 assumes a case where the "location of main body" is "inside" the cradle 20, the "state of cradle lid" is "open", and the "electric power remaining in battery of cradle" is "absent". That is, a case is assumed where the main body uCOM 110 does not receive electric power from the cradle 20 via the electric power supply terminal 251 (VBAS) and the electric power acquiring terminal 151 (VBAS) due to the absence of electric power remaining in the battery 231 of the cradle 20, and the lid section 280 is in the open state. In such a case, the main body uCOM 110 performs the "first assignment". In this case, key input is kept "enabled".

The example of the correspondence relationship between various states and the assignment of processes to keys has been described above.

3. CONCLUSION

As described above, according to the embodiment of the present disclosure, there is provided a speaker device including a controller that controls assignment of a process to a key on the basis of whether or not the speaker device is stored in a case. The key is configured to be inputted to an operation section of the speaker device. The process is executed in a case where the key is inputted to the operation section. Such a configuration enables a process to be more effectively assigned to a key.

4. MODIFICATION EXAMPLE

A preferred embodiment(s) of the present disclosure has/have been described above in detail with reference to the accompanying drawings, but the technical scope of the present disclosure is not limited to such an embodiment(s). A person skilled in the art may find various alterations and modifications within the scope of the appended claims, and it should be understood that they will naturally come under the technical scope of the present disclosure.

FIG. 7 is a diagram for describing a modification example. Referring to FIG. 7, in comparison with the example illustrated in FIG. 5, the cradle 20 includes a detection terminal 254 that is different from the electric power supply terminal 251 (VBAS). In addition, referring to FIG. 7, in comparison with the example illustrated in FIG. 5, the earphone 10 includes a detection terminal 154 that is different from the electric power acquiring terminal 151 (VBAS). The detection terminal 154 of the earphone is coupled to the detection terminal 254 of the cradle 20 when the earphone 10 is stored in the cradle 20.

The example has been described above in which whether or not the earphone 10 is stored in the cradle 20 is determined on the basis of whether or not the main body uCOM 110 receives electric power from the cradle 20 via the electric power supply terminal 251 (VBAS) and the electric power acquiring terminal 151 (VBAS). In the modification example, however, the main body uCOM 110 determines whether or not the earphone 10 is stored in the cradle 20, on the basis of whether or not the detection terminal 154 of the earphone 10 is coupled to the detection terminal 254 of the cradle 20. This makes it possible to execute a process (for example, the initialization process or the hardware reset process) to be executed in a case where the earphone 10 is stored in the cradle 20 even if the earphone 10 does not receive electric power from the cradle 20.

In addition, the effects described herein are merely illustrative and exemplary, but not limitative. That is, the technique according to the present disclosure may achieve, in addition to or in place of the above effects, other effects that are obvious to those skilled in the art from the description of the present specification.

It is to be noted that the following configurations also fall within the technical scope of the present disclosure.

(1)

A speaker device including a controller that controls assignment of a process to a key on the basis of whether or not the speaker device is stored in a case, the key being configured to be inputted to an operation section of the speaker device, the process being executed in a case where the key is inputted to the operation section.

(2)

The speaker device according to (1), in which the controller determines whether or not the speaker device is stored in the case, on the basis of whether or not electric power is received from the case.

(3)

The speaker device according to (1), in which the controller determines whether or not the speaker device is stored in the case, on the basis of whether or not a detection terminal is coupled to the case, the detection terminal being different from a coupling terminal for receiving electric power from the case.

(4)

The speaker device according to any one of (1) to (3), in which the controller controls whether to enable or disable input of the key to the operation section, on the basis of whether or not a lid section of the case is open in a case where the speaker device is stored in the case.

(5)

The speaker device according to (4), in which the controller disables the input of the key to the operation section in a case where the speaker device is stored in the case and the lid section is closed.

(6)

The speaker device according to any one of (1) to (5), in which the controller assigns a first process to a first key in a case where the speaker device is not stored in the case, and assigns a second process to a second key in a case where the speaker device is stored in the case.

(7)

The speaker device according to (6), in which the second process includes at least any one of an initialization process or a hardware reset process.

(8)

The speaker device according to any one of (1) to (7), in which the speaker device includes an earphone or a headphone.

(9)

An assignment method including controlling assignment of a process to a key on the basis of whether or not a speaker device is stored in a case, the key being configured to be inputted to an operation section of the speaker device, the process being executed in a case where the key is inputted to the operation section.

REFERENCE SIGNS LIST

10 Earphone
110 Main body uCOM
120 Touch sensor
130 Battery
140 Speaker
145 Communication section
151 Electric power acquiring terminal
152 Lid open/close detecting terminal
154 Detection terminal
20 Cradle
210 Cradle uCOM
231 Battery
232 EN charging IC
233 Voltage detecting circuit
240 Cradle lid open/close switch
251 Electric power supply terminal
252 Lid open/close detecting terminal
254 Detection terminal
280 Lid section
290 Storage section

The invention claimed is:

1. A speaker device, comprising:

a controller configured to:

control assignment of a process to a key based on whether the speaker device is stored in a case, wherein the key being configured to be inputted to an operation section of the speaker device, and the process being executed when the key is inputted to the operation section; and disable input of the key to the operation section based on a determination that a lid section of the case is closed when the speaker device is stored in the case.

2. The speaker device according to claim 1, wherein the controller is further configured to determine whether the speaker device is stored in the case, based on whether electric power is received from the case.

3. The speaker device according to claim 1, wherein the controller is further configured to determine whether the speaker device is stored in the case, based on whether a detection terminal is coupled to the case, the detection terminal being different from a coupling terminal for receiving electric power from the case.

4. The speaker device according to claim 1, wherein the controller is further configured to enable input of the key to the operation section, based on a determination that the lid section of the case is open when the speaker device is stored in the case.

5. The speaker device according to claim 1, wherein the controller is further configured to:

assign a first process to a first key when the speaker device is not stored in the case, and assign a second process to a second key when the speaker device is stored in the case.

6. The speaker device according to claim 5, wherein the second process includes at least any one of an initialization process or a hardware reset process.

7. The speaker device according to claim 1, wherein the speaker device includes an earphone or a headphone.

8. An assignment method, comprising:

controlling assignment of a process to a key based on whether a speaker device is stored in a case, wherein the key being configured to be inputted to an operation section of the speaker device, and the process being executed when the key is inputted to the operation section; and disabling input of the key to the operation section based on a determination that a lid section of the case is closed when the speaker device is stored in the case.

9. A speaker device, comprising:

a controller configured to:

control assignment of a plurality of processes to a plurality of keys based on whether the speaker device is stored in a case, wherein the plurality of keys is configured to be inputted to an operation section of the speaker device, the plurality of processes is executed when the key is inputted to the operation section, a first process of the plurality of processes is assigned to a first key of the plurality of keys when the speaker device is not stored in the case, and a second process of the plurality of processes is assigned to a second key of the plurality of keys when the speaker device is stored in the case.

* * * * *